US008333533B1

(12) United States Patent
Fiorina

(10) Patent No.: US 8,333,533 B1
(45) Date of Patent: Dec. 18, 2012

(54) MANUAL CURBING DEVICE

(76) Inventor: John T. Fiorina, Latrobe, PA (US)

( * ) Notice: Subject to any disclaimer, the term of this patent is extended or adjusted under 35 U.S.C. 154(b) by 10 days.

(21) Appl. No.: 13/136,453

(22) Filed: Aug. 2, 2011

(51) Int. Cl.
*E01C 11/22* (2006.01)

(52) U.S. Cl. ..... 404/98; 404/105

(58) Field of Classification Search ..... 404/97, 404/98, 105; 425/218
See application file for complete search history.

(56) References Cited

U.S. PATENT DOCUMENTS 2,541,547 A 2/1951 Robinson
3,585,911 A * 6/1971 Vlasic ..... 404/98
3,733,141 A 5/1973 James, III
4,027,990 A * 6/1977 Merrill ..... 404/98
5,527,129 A * 6/1996 McKinnon ..... 404/98
7,377,719 B1 * 5/2008 Elizondo et al. ..... 404/98
2002/0021938 A1 * 2/2002 Matthias et al. ..... 404/98

* cited by examiner

*Primary Examiner* — Raymond W Addie
(74) *Attorney, Agent, or Firm* — R. S. Lombard

(57) ABSTRACT

A manual curbing device includes a box-shaped hopper with an open top and bottom. The hopper is for receiving asphalt concrete via the open top. A pair of skids is each attached to opposite sides of the bottom of the hopper on the exterior thereof. The bottom portion of the front of the hopper has an opening of predetermined size to permit the expulsion of the asphalt concrete by gravity. The device includes at least one flat thin removable interchangeable extrusion curb forming plate having an opening sized and shaped to form the cross-sectional size and shape of a curb to be extruded. A pair of L-shaped curb forming plate retaining brackets are operatively attached in predetermined position to opposite exterior sides of the hopper proximate the front thereof to form a slot for receiving the flat removable interchangeable extrusion curb forming plate. A rear handle is operably attached to the back of the hopper.

16 Claims, 5 Drawing Sheets

MANUAL CURBING DEVICE

BACKGROUND OF THE INVENTION

The invention relates to a device for forming curbs of asphalt concrete. In particular, a manual device for forming curbs of the type especially for driveways and parking lots.

In U.S. Pat. No. 2,541,547 issued to Lawrence T. Robinson on Feb. 13, 1951 is disclosed a Molding Apparatus for Roadway markers. The Robinson patent discloses a molding machine for forming raised molds which become integral with a highway. The molding machine is capable of forming molds of various cross-section and of infinite length. In particular, the Robinson molding machine is portable and provides a mold, into which an aggregate mix of asphalt or a like material commonly used for surfacing may be poured, and as the machine is moved along the highway, the mold is preliminarily formed by a first elongated mold of substantially inverted V-shape, subsequent to which the mold is further compacted by a second elongated mold of substantially inverted V-shape.

U.S. Pat. No. 3,585,911 issued to John Vlasic on Jun. 22, 1971 discloses a curbing apparatus consisting of a manually operable wheeled vehicle for forming curb mix asphalt into a uniform curb. The vehicle carries a curb forming shoe with a hopper thereabove and a manually controlled shutter and plunger. The asphalt mix is loaded into the hopper. Operation of the shutter permits the asphalt mix to fall by gravity into the shoe. Operation of the plunger compacts asphalt mix in the shoe to form the mix into a section of desired curbing.

In U.S. Pat. No. 3,733,141 issued to William T. James, III on May 15, 1973 is disclosed curbing forming machine consisting of a manually operable steerable asphaltic concrete or portland cement mixes. The machine has a curb forming shoe with a hopper above and in communication therewith and a manually controlled ram to which a closure plate is hinged. Operation of the ram and the closure plate permits the asphaltic or portland cement mix to fall by gravity into the shoe where operation of the ram compacts the mix in the shoe to form the curbing. The reaction force moves the machine away from the newly extruded curbing.

The foregoing patents all disclose a somewhat complex manual device for forming curbing from asphalt concrete. It is an object of the present invention provide an improved asphalt mix curbing device that is simple, portable, and efficient, with the ability of easily changing the cross-section of the curbs produced by the device.

SUMMARY OF THE INVENTION

The present invention provides a manual curbing device including a box-shaped hopper with an open top and bottom. The hopper is for receiving asphalt concrete via the open top. A pair of skids is each attached to opposite sides proximate the bottom of the hopper on the exterior thereof. The bottom portion of the front of the hopper has an opening of predetermined size to permit the expulsion of the asphalt concrete by gravity. The device includes at least one flat thin removable interchangeable extrusion curb forming plate having an opening sized and shaped to form the cross-sectional size and shape of a curb to be extruded which in operation fits over the hopper opening. A pair of L-shaped curb forming plate retaining brackets are operatively attached in predetermined position to opposite exterior sides of the hopper proximate the front thereof to form a slot for receiving the flat removable interchangeable extrusion curb forming plate. A rear handle is operably attached to the back of the hopper.

Preferably, the device further includes a front handle operatively attached to the upper portion of the front of the hopper. Preferably, each of the skids have an L-shaped cross-section. Desirably, each of the skids have an upward inclination at the front and rear end thereof. The bottom of each of the skids has a smooth surface. Preferably, the front handle is attached to the upper portion of the hopper a predetermined distance below the top of the front of the hopper.

Preferably, each of the L-shaped curb forming plate retaining brackets is made of metal such as steel.

The opening of the at least one flat removable interchangeable extrusion curb forming plate may have an inverted U-shape or V-shape, for example.

The flat removable interchangeable extrusion curb forming plate preferably has a first upper wing portion which is a monolithic part thereof extending beyond the opposite exterior sides of the hopper in the operative position. The first upper wing portion desirably has a first plate grasping handle operatively attached on opposites thereof. Preferably, each of the first plate grasping handles extend perpendicularly on opposite sides of the upper wing portion of the flat removable interchangeable extrusion curb forming plate.

Preferably, the device includes a flat removable solid plate without an opening, whereby the flat removable interchangeable extrusion curb forming plate can be removed from the slot and replaced with the flat removable solid plate without opening for permitting movement of the curbing device with hopper loaded with asphalt concrete without forming a curb. The flat removable solid plate without an opening desirably has a second upper wing portion which is a monolithic part thereof extending beyond the opposite exterior sides of the hopper in the operative position. The second upper wing portion has a second plate grasping handle operatively attached on opposite sides thereof. Preferably, each of the second plate grasping handles extend perpendicularly on opposite sides of the second upper wing portion of the flat removable solid plate.

The front and rear handles are preferably U-shaped.

BRIEF DESCRIPTION OF THE DRAWINGS

Further details of the invention will become clear from the following description of the illustrative embodiments represented in the drawings, in which.

DETAILED DESCRIPTION OF THE PARTICULAR EMBODIMENTS

Figure 1:
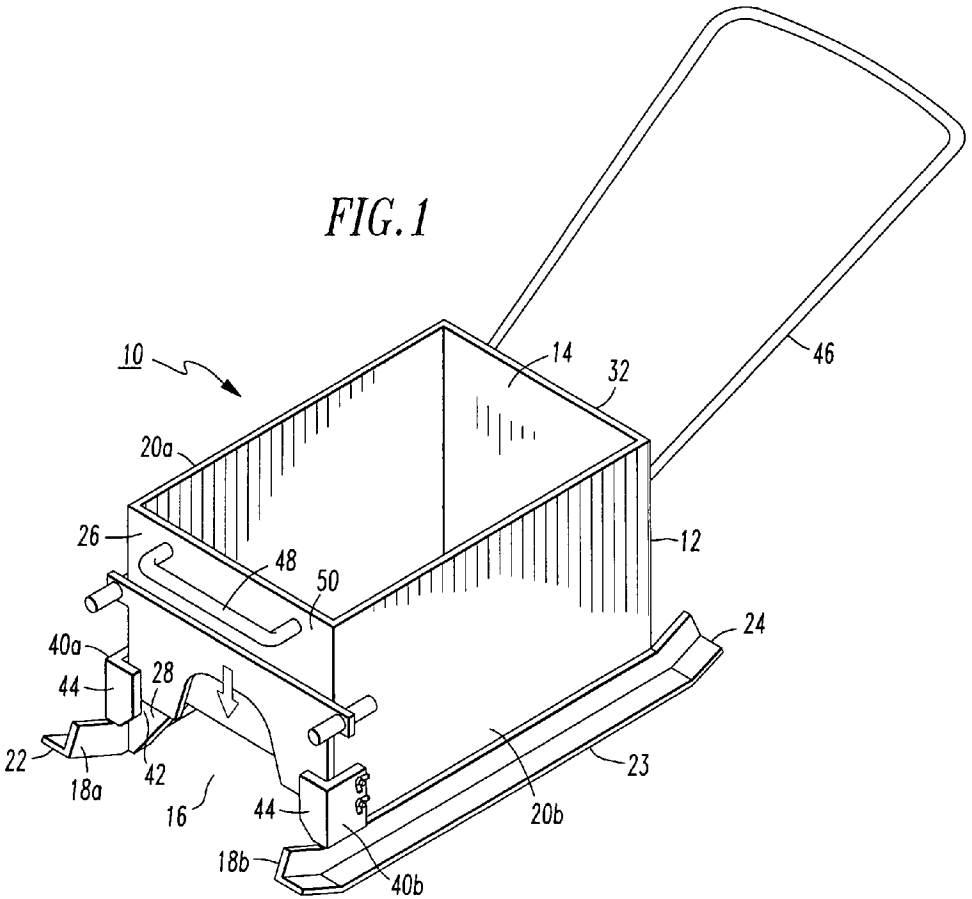
FIG. 1 is a perspective view of the manual curbing device of the present invention with a flat removable interchangeable extrusion curb forming plate being inserted in the slot between the brackets.

With reference to FIGS. 1-5, there is shown a manual curbing device 10 of the present invention particularly for making curbs for driveways and parking lots of asphalt concrete. The manual curbing device 10 includes a box-shaped hopper 12 which is preferably made of steel. The hopper 12 has an open top 14 and open bottom 16. In operation an asphalt concrete is deposited into the hopper 12 through the open top 14 until the hopper is loaded as desired.

A pair of skids 18*a*, 18*b* each attached to opposite sides 20*a*, 20*b* by welding, for example not shown, to opposite sides of the hopper 12. The skids may be made of steel angle iron, for example, 1½ inch angle iron, 3/16 inch thick and 25⅜ inches long from end to end. The skids 18*a*, 18*b* may have an L-shaped cross-section. Each of the skids 18*a*, 18*b* has an upward inclination at the front end 22 and rear end 24 thereof. The bottom 23 of the skids 18*a*, 19*b* are smooth so that in operation they slide easily along the ground.

Figure 2:
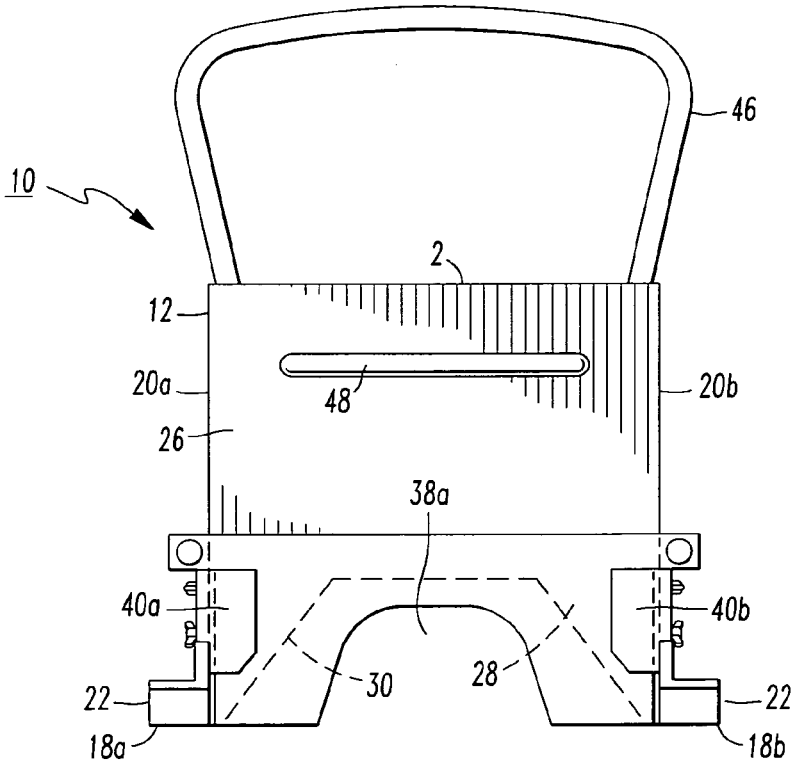
FIG. 2 is a front elevation view of the manual curbing device shown in FIG. 1 with the exception that the flat removable interchangeable extrusion curb forming plate is fully inserted in the slot between the brackets.
Figure 3:
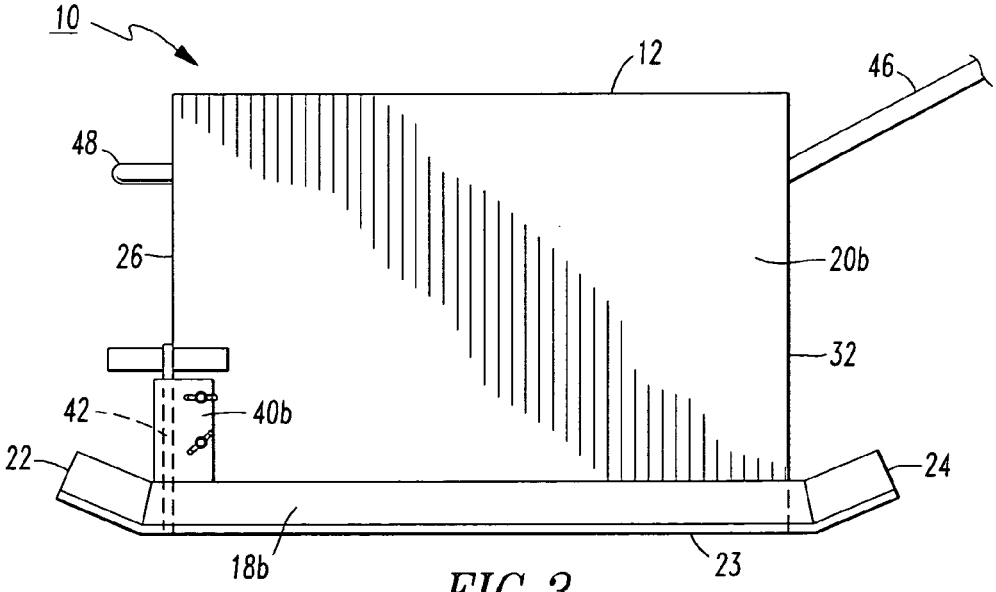
FIG. 3 is a left side elevation view of the manual curbing device as shown in FIG. 2.

With reference to FIGS. 1 and 2, the front 26 of the hopper 12 at the bottom portion 28 thereof has an opening 30 of predetermined size and shape such as, 4⅝ inches high, with a trapezoid shape, with the top of the trapezoid, for example, 7¼ inches wide and the bottom of the trapezoid being 12¼ inches wide. The opening 30 is sized to permit the expulsion of asphalt concrete by gravity without the need for any other device for pushing the asphalt through the hopper. The dimensions of the hopper 12 maybe for the front 26 and back 32, for example, 12¼ inches wide and 20¼ high, and for the opposite sides 20*a*, 20*b*, for example, 20¼ inches by 20¼ inches. The thickness of these components of the hopper may be ⅛ inch, for example. The skids 18*a*, 18*b* are preferably welded to the opposite sides 20*a*, 20*b* such that the bottom 34 of the hopper is flush with the ground in operation this prevents any unwanted leaking of the asphalt concrete.

In operative relationship with the hopper opening 30 the device 10 includes at least one flat removable interchangeable extrusion curb forming plate 36*a*, 36*b* also preferably made of steel. The curb forming plates 36*a*, 36*b* have a thickness of ⅛ inch, for example. Each curb forming plate 36*a*, 36*b* has an opening 38*a*, 38*b* sized and shaped to form the cross-sectional size and shape of the curb, not shown, to be extruded. The curb forming plates 36*a*, 36*b* in operation fit over hopper opening 30. For example, a pair of L-shaped steel brackets 40*a*, 40*b* are each attached to opposite sides 20*a*, 20*b* by bolts passing through corresponding apertures in the opposite sides 20*a*, 20*b*, not shown, engaging wing nuts 42, so that the brackets can be easily removed for maintaining the device 10. Of course, as an alternative the brackets 40*a*, 40*b* may be welded to the opposite sides 20*a* 20*b*. The brackets 40*a*, 40*b* are positioned with respect to the opposite sides 20*a*, 20*b* proximate the front 26 of the hopper 12 such that a slot 42 is formed between the front 44 of the brackets of sufficient size to receive and retain the flat removable interchangeable extrusion forming plate 36*a*, 36*b* so they may cover the hopper opening 30.

The device 10 includes a rear handle 46 preferably made of steel and attached to the back 32 of the hopper 12 by welding, not shown. Preferably a front handle 48 also made of steel is similarly attached to the front 26 of the hopper 12. Preferably the front handle 48 is attached to the upper portion 50 of the front 26. The front handle 48 may be attached a predetermined maximum distance below the top of front 26 of the hopper 12 such as no more than 20% of the height of the hopper, so that it still permits easy removal and insertion of the at least one flat removable interchangeable extrusion forming plate 36*a*, 36*b*. The rear handle 46 and the front handle 48 may be U-shaped as shown in FIG. 1.

Figure 4:
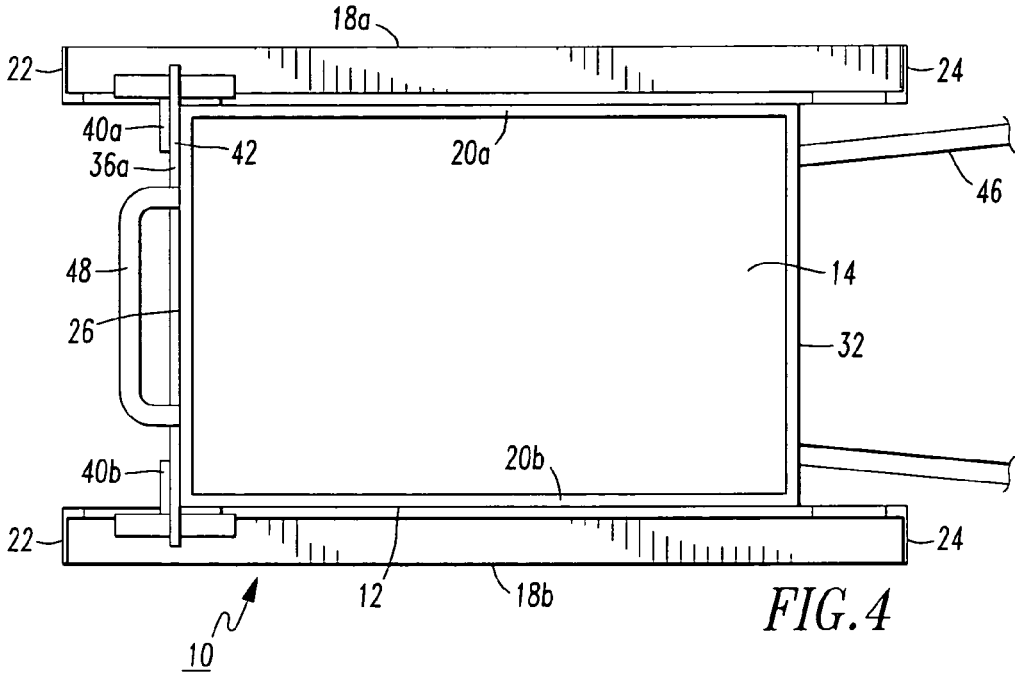
FIG. 4 is a plan view of the manual curbing device shown in FIG. 2.
Figure 5:
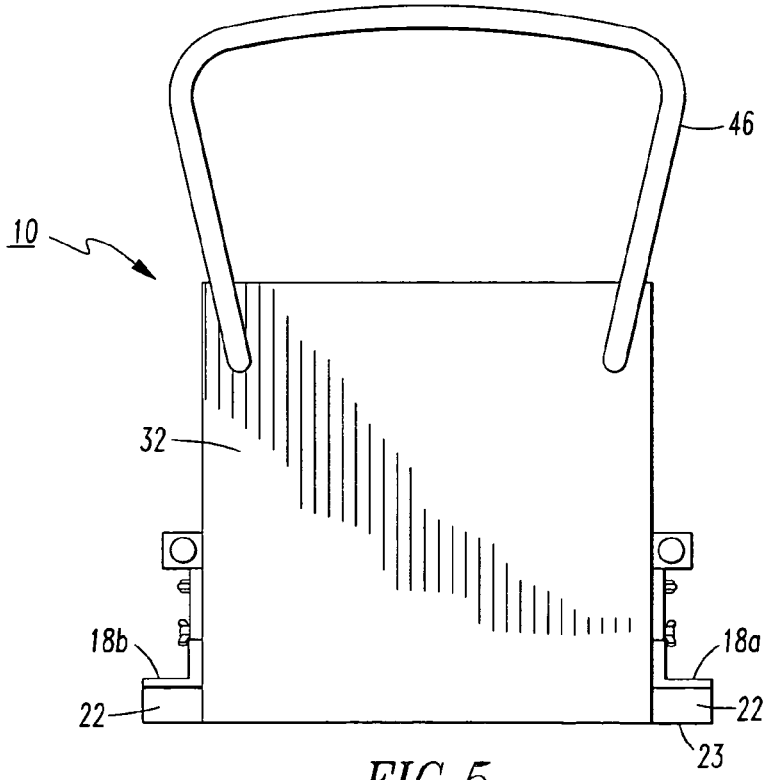
FIG. 5 is a rear elevation view of the manual curbing device shown in FIG. 2.
Figure 6:
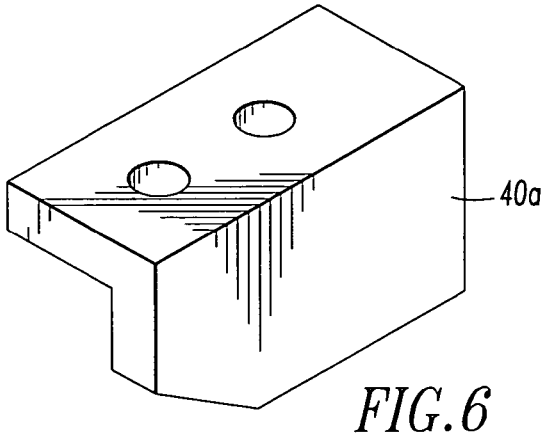
FIG. 6 is a perspective view of the left side bracket shown in FIG. 1 rotated 90°.
Figure 7:
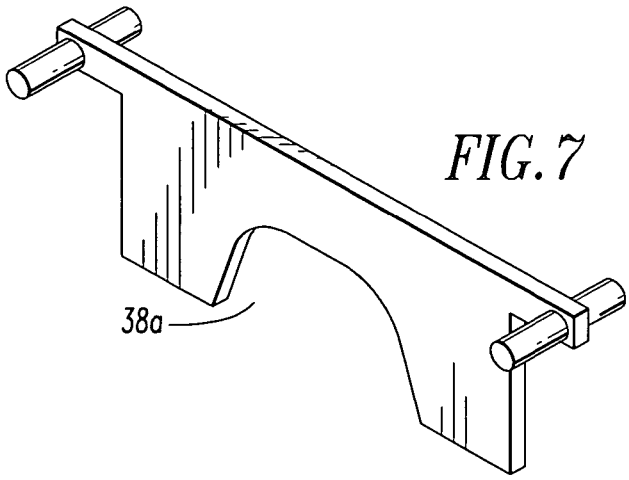
FIG. 7 is a perspective view of the flat removable interchangeable extrusion curb forming plate with an inverted U-shaped opening.
Figure 9:
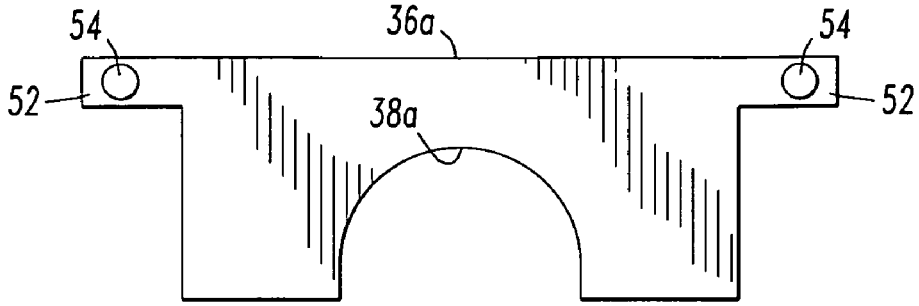
FIG. 9 is a front elevation view of the flat removable interchangeable extrusion curb forming plate with an inverted U-shaped opening.
Figure 10:
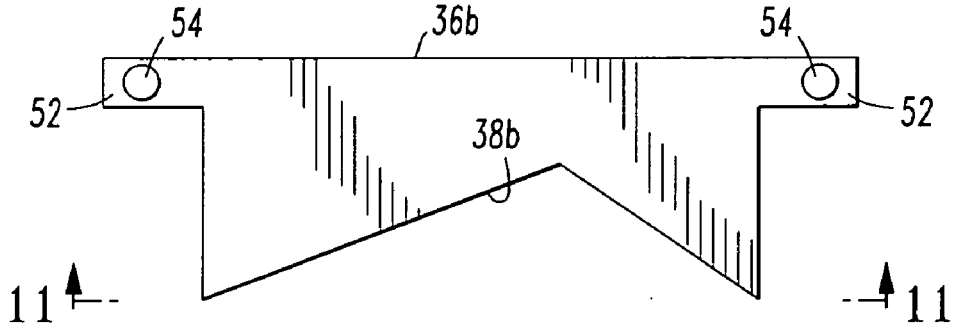
FIG. 10 is a front elevation view of the flat removable interchangeable extrusion curb forming plate with an inverted V-shaped opening; and, FIG. 11 is a plan view of the flat removable interchangeable extrusion curb forming plate with an inverted V-shaped opening shown in FIG. 10.
Figure 11:
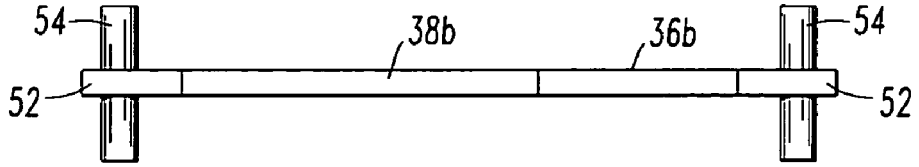

As shown for example, in FIGS. 7 and 9, the opening 38*a* of the flat removable interchangeable extrusion curb forming plate 36*a* has an inverted U-shape. As shown for example, in FIG. 10, the opening 38*b* of the flat removable interchangeable extrusion curb forming plate 36*b* has an inverted V-shape. The openings 38*a*, 38*b* form the cross-section of the curb as desired. Preferably, each of the flat removable interchangeable extrusion curb forming plates 36*a*, 36*b* have a first upper wing portion 52 which is a monolithic portion thereof in the operative position extending beyond the opposite sides 20*a*, 20*b* of the hopper 12 as shown in FIGS. 1, 2 and 4. The first upper wing portion 52 has a first plate grasping handle 54 operatively attached and preferably extending perpendicularly on opposite sides thereof.

Figure 8:
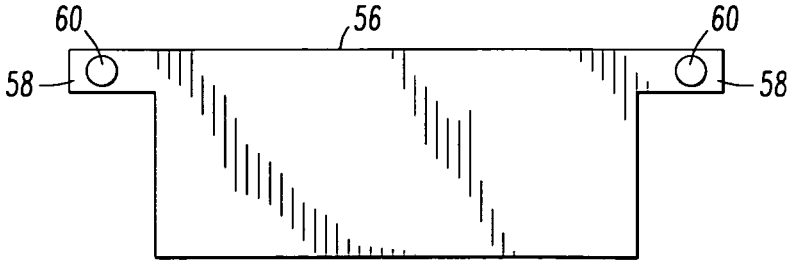
FIG. 8 is a front elevation view of the flat removable solid plate without an opening.

The manual curbing device 10 includes a flat removable solid plate 56 without an opening as shown in FIG. 8. The flat removable interchangeable extrusion curb forming plate 36*a*, 36*b* can be removed from the slot and replaced with the flat removable solid plate 56 without opening for permitting movement of the curbing device with hopper loaded with asphalt concrete without forming a curb. Also, the flat removable solid plate 56 may be used as a preliminary or starting workpiece which can then be made by cutting out the desired opening into the flat removable interchangeable extrusion curb forming plate 36*a*, 36*b* as described.

The flat removable solid plate 56 without an opening has a second upper wing portion 58 which is a monolithic portion thereof extending beyond the opposite exterior sides 20*a*, 20*b* of the hopper 12 in the operative position. The second upper wing portion 58 has a second plate grasping handle 60 operatively attached on opposite sides thereof. Preferably each of the second plate grasping handles 60 extend perpendicularly on opposite sides of the second upper wing portion of the flat removable solid plate 56 in a like manner has for plates 36*a*, 36*b*.

In operation the desired flat removable interchangeable extrusion curb forming plate 36*a*, 36*b* is inserted into slot 42 to provide the desired cross-section of curb to be formed. Of course, the extrusion curb forming plate 36*a*, 36*b* of the present invention may be provided with any cross-sectional shape of curb to be formed and is therefore not limited to an inverted U-shape or inverted V-shape. In any event, the opening in the plates 36*a*, 36*b* provides the cross-sectional shape of the curb to be extruded. The device 10 in order to form a curb is placed along the side of a driveway or parking lot and the hopper 12 is loaded with asphalt concrete by means of a shovel, for example. The rear handle 46 is used to manually pull the hopper 12 along the ground. As the hopper 12 is moved the asphalt concrete mixed is extruded out of the opening of the plate 36*a*, 36*b* by the force of gravity alone without the need as mentioned of a device to push it through the opening or any additional shaping means. The front handle 48 may also be used by an additional person to push the device if needed to move the device. In the case where there is asphalt concrete remaining in the hopper 12 after completion of a curb, the plate 36*a*, 36*b* may be removed and replaced with solid plate 56 so that the asphalt concrete is prevented from being expelled from the hopper 12. When the hopper 12 is moved to the beginning position to form a new curb the solid plate 56 may then be exchanged for the desired extrusion curb forming plate 36*a*, 36*b*.

The device 10 is very simple in design and operates reliably. It has been found the present invention is much more efficient for doing relatively small jobs than attaching a curber to a mechanized paver, which requires quite a lot of time to install the curber.

What is claim is:

1. A manual curbing device comprising:

a box-shaped hopper with an open top and bottom, the box-shaped hopper for receiving asphalt concrete via the open top, a pair of skids each attached to opposite sides of proximate the bottom of the hopper on the exterior thereof, the bottom portion of the front of the hopper having an opening of predetermined size to permit the expulsion of the asphalt concrete by gravity, at least one flat removable interchangeable extrusion curb forming plate having an opening sized and shaped to form the cross-sectional size and shape of a curb to be extruded, a pair of L-shaped curb forming plate retaining brackets operatively attached predetermined position to opposite exterior sides of the hopper proximate the front thereof to form a slot for receiving the flat removable interchangeable extrusion curb forming plate, and, a rear handle affixed to the back of the hopper.

2. The manual curbing device of claim 1, further comprising a front handle operatively attached to the upper portion of the front of the hopper.

3. The manual curbing device of claim 1, wherein each of the skids have an L-shaped cross-section.

4. The manual curbing device of claim 1, wherein each of the skids have an upward inclination at the front and rear end thereof.

5. The manual curbing device of claim 2, wherein the front handle is attached to the upper portion of the front of the hopper a predetermined distance below the top thereof.

6. The manual curbing device of claim 1, wherein each of the L-shaped curb forming retaining brackets is made of metal.

7. The manual curbing device of claim 1, wherein the bottom of each of the skids has a smooth surface.

8. The manual curbing device of claim 1, wherein the opening of the at least one flat removable interchangeable extrusion curb forming plate has an inverted U-shape.

9. The manual curbing device of claim 1, wherein the opening of the at least one flat removable interchangeable extrusion curb forming plate has an inverted V-shape.

10. The manual curbing device of claim 1, wherein the at least one flat removable interchangeable extrusion curb forming plate having a first upper wing portion extending beyond the opposite exterior sides of the hopper in the operative position, the first upper wing portion having a first plate grasping handle operatively attached and extending on opposites thereof, whereby the at least one flat removable interchangeable extrusion curb forming plate may be easily removed and replaced by another flat removable interchangeable extrusion curb forming plate.

11. The manual curbing device of claim 1, wherein each of the first plate grasping handles extend perpendicularly on opposite sides of the upper wing portion of the flat removable interchangeable extrusion curb forming plate.

12. The manual curbing device of claim 1, further comprising a flat removable solid plate without an opening, whereby the flat removable interchangeable extrusion curb forming plate can be removed from the slot and replaced with the flat removable solid plate without opening for permitting movement of the curbing device with hopper loaded with asphalt concrete without forming a curb.

13. The manual curbing device of claim 1, wherein the flat removable solid plate without an opening has a second upper wing portion extending beyond the opposite exterior sides of the hopper in the operative position, the second upper wing portion having a plate grasping handle operatively attached on opposite sides thereof.

14. The manual curbing device of claim 12, wherein each of the second plate grasping handles extend perpendicularly on opposite sides of the second upper wing portion of the flat removable solid plate.

15. The manual curbing device of claim 1, wherein the rear handle is U-shaped.

16. The manual curbing device of claim 2, wherein the front handle is U-shaped.

* * * * *